US009859630B2

(12) United States Patent
MacNaughton et al.

(10) Patent No.: US 9,859,630 B2
(45) Date of Patent: Jan. 2, 2018

(54) CONDUCTIVE CONNECTION ASSEMBLY, METHOD FOR MANUFACTURING THE SAME AND KIT FOR A BODY COMPRISING CARBON FIBRE-REINFORCED MATERIAL

(71) Applicant: Tyco Electronics UK Ltd., Swindon, Wiltshire (GB)

(72) Inventors: Roy MacNaughton, Swindon (GB); Matthew Stubbs, Swindon (GB)

(73) Assignee: Tyco Electronics UK Ltd., Swindon, Wiltshire (GB)

( * ) Notice: Subject to any disclaimer, the term of this patent is extended or adjusted under 35 U.S.C. 154(b) by 412 days.

(21) Appl. No.: 14/371,705

(22) PCT Filed: Jan. 8, 2013

(86) PCT No.: PCT/EP2013/050178

§ 371 (c)(1),
(2) Date: Jul. 10, 2014

(87) PCT Pub. No.: WO2013/104596

PCT Pub. Date: Jul. 18, 2013

(65) Prior Publication Data

US 2014/0374138 A1 Dec. 25, 2014

(30) Foreign Application Priority Data

Jan. 13, 2012 (EP) ..... 12151158

(51) Int. Cl.
*H01R 4/64* (2006.01)
*H01R 11/01* (2006.01)
(Continued)

(52) U.S. Cl.
CPC ..... *H01R 4/64* (2013.01); *H01R 11/01* (2013.01); *H01R 11/11* (2013.01); *H01R 4/06* (2013.01)

(58) Field of Classification Search
None
See application file for complete search history.

(56) References Cited

U.S. PATENT DOCUMENTS 44,880 A * 11/1864 Munson ..... H01B 5/08
174/129 R
368,765 A * 8/1887 Hammer ..... H01H 85/046
174/129 R (Continued)

FOREIGN PATENT DOCUMENTS

CN 201440567 4/2010

OTHER PUBLICATIONS

International Search Report and Written Opinion issued by the European Patent Office, dated Mar. 15, 2013, for related International Application No. PCT/EP2013/050178; 9 pages.

(Continued)

*Primary Examiner* — Chau N Nguyen
*Assistant Examiner* — Muhammed Azam
(74) *Attorney, Agent, or Firm* — Faegre Baker Daniels LLP

(57) ABSTRACT

The invention relates to a conductive connection assembly (5), a method for manufacturing the same and a kit for a body (23) comprising carbon fibre-reinforced material, e.g. for a vehicle comprising a carbon fibre-reinforced body (23), with an electrical structural network for conducting electric discharges. The conductive connection assembly (5) includes a conductive interconnection element (1) with a conductive braid material (B). Furthermore, a kit is provided, the kit including at least two conductive connection assemblies (5) that are provided with differently shaped interconnection elements (1). Finally, a method that comprises the step of reshaping longitudinal ends (3, 4) of a braid material (B) is provided according to the invention.

12 Claims, 5 Drawing Sheets

(51) Int. Cl.
*H01R 11/11* (2006.01)
*H01R 4/06* (2006.01)

(56) References Cited

U.S. PATENT DOCUMENTS 1,929,374 A * 10/1933 Pearson ..... H01R 4/50 439/799
1,932,602 A * 10/1933 Ratta ..... H01R 4/64 439/506
1,966,132 A * 7/1934 Pearson ..... H01R 4/643 24/19
1,981,343 A * 11/1934 Borden ..... H01R 4/46 439/777
1,997,627 A * 4/1935 Casey ..... H01R 4/38 174/127
3,058,087 A * 10/1962 Piasecki ..... H01R 4/46 439/100
4,883,925 A * 11/1989 Graf ..... B29C 65/66 174/84 R
4,902,245 A * 2/1990 Olsson ..... H01R 11/11 439/492
4,973,370 A * 11/1990 Kreinberg ..... H01R 4/2495 156/50
5,030,797 A * 7/1991 Logstrup ..... H01R 35/02 174/129 R
5,037,317 A * 8/1991 Schwenk ..... H01R 4/62 439/874
5,131,861 A * 7/1992 Auclair ..... H01R 4/56 439/218
5,288,245 A * 2/1994 Piana ..... H01R 11/12 439/491
5,326,273 A * 7/1994 Kamon ..... H01R 4/62 174/94 R
5,364,281 A * 11/1994 Leto ..... H01R 4/643 403/378
5,631,444 A * 5/1997 Rook ..... H01R 4/646 174/78
5,738,554 A * 4/1998 Borger ..... H01R 4/02 219/203
D400,169 S * 10/1998 Endo ..... D13/120
7,247,795 B2 * 7/2007 Sumi ..... H01R 24/562 174/74 R
7,427,219 B1 * 9/2008 Hua ..... H01R 4/023 174/84 R
2002/0094728 A1 * 7/2002 Kim ..... H01R 11/287 439/754
2003/0040215 A1 * 2/2003 Kleen ..... H01R 4/70 439/510
2003/0047400 A1 * 3/2003 Warner ..... B61K 13/00 191/6
2008/0066306 A1 * 3/2008 Bernardini ..... H01B 1/124 29/877
2008/0304211 A1 * 12/2008 Shimizu ..... H01R 4/185 361/600
2010/0075535 A1 * 3/2010 Mizutani ..... H01R 13/504 439/588
2010/0210140 A1 * 8/2010 Metral ..... H01R 13/502 439/607.41
2011/0111640 A1 * 5/2011 Hara ..... H01R 4/64 439/660
2012/0094548 A1 * 4/2012 Lumpkins ..... H01M 10/425 439/801
2012/0244759 A1 * 9/2012 Tsuji ..... H01R 4/029 439/877
2012/0279748 A1 * 11/2012 Martens ..... H01R 4/00 174/80
2012/0302089 A1 * 11/2012 Shuey ..... H01R 11/09 439/386
2014/0308847 A1 * 10/2014 Tanaka ..... H01R 9/032 439/607.41

OTHER PUBLICATIONS

International Preliminary Report on Patentability issued by The International Bureau of WIPO, Geneva, Switzerland, dated Jul. 15, 2014, for International Application No. PCT/EP2013/050178; 5 pages.
Fourth Office Action issued by the State Intellectual Property Office, dated Oct. 30, 2017, for related Chinese Patent Application No. 201380013430.0; 9 pages.
English translation of Fourth Office Action issued by the State Intellectual Property Office, dated Oct. 30, 2017, for related Chinese Patent Application No. 201380013430.0; 12 pages.

* cited by examiner

CONDUCTIVE CONNECTION ASSEMBLY, METHOD FOR MANUFACTURING THE SAME AND KIT FOR A BODY COMPRISING CARBON FIBRE-REINFORCED MATERIAL

BACKGROUND OF THE DISCLOSURE

The present invention relates to a conductive connection assembly for connecting conductor segments of an electrical structural network of a body to other conductive elements of the body, the conductive connection assembly being adapted to conduct electric discharges and comprising a conductive interconnection element with a conductive section. Further, the present invention relates to a kit. Moreover, the present invention relates to a method for manufacturing a conductive connection assembly for connecting conductor segments of an electrical structural network of a body to other conductive elements of the body, the conductive connection assembly being capable of conducting electrical discharges.

SUMMARY OF THE DISCLOSURE

By using carbon fibre-reinforced material, for instance carbon fibre-reinforced polymers, the total weight of the body can be reduced compared to traditional bodies of aluminium without affecting the structural integrity of the body. In contrast to aluminium, carbon fibre-reinforced polymers cannot conduct electrical energy in considerable amounts. Hence, a body which is e.g. mainly made of carbon fibre-reinforced polymer cannot readily conduct electric and in particular atmospheric discharges, e.g. lightning strikes hitting the body. This causes a threat to occupants staying in the body or items stored in the body. Such a body is for instance a car body, a boat or ship body, i.e. a hull and/or superstructures of a boat or a ship, a fuselage of an aircraft, a body of a device or even a building. Thus, the electrical structure network has to conduct the electric energy of the electric discharges.

For installing the electrical structural network, the conductor segments may be affixed and e.g. bonded to the carbon fibre-reinforced material. In order to establish a conductive connection to other conductive elements, e.g. to other conductor segments of the network, the conductor segments may be connected to the other conductive elements by well-known and proven methods, e.g. they may be connected by a weld or a rivet connection. As the mechanical properties of the carbon fibre-reinforced material of the body and the metallic electrical structural network are different, the body tends to move relative to the network, e.g. when the aircraft is operating. Such a movement may affect the connection and in particular a bonding connection between the conductor segments and the carbon fibre-reinforced material of the body, thereby reducing the durability of the body.

In view of these disadvantages, an object underlying the invention is to provide for a body, in particular with a carbon fibre-reinforced structure and an electrical structural network, the network being easily and durably installable.

The object is achieved according to the invention for the conductive connection assembly mentioned in the beginning in that the conductive section is formed by a hollow cylindrical braid material with two longitudinal ends, the longitudinal ends being consolidated to have a rigid plate-like form.

For the kit mentioned above, the object is achieved according to the present invention by at least two conductive connection assemblies according to the invention, wherein the conductive interconnection element of one of the conductive connection assemblies is different in length or its longitudinal ends are differently arranged with respect to each other compared to the conductive interconnection element of another one of the conductive connection assemblies.

According to the invention, the object is achieved for the method mentioned in the beginning in that the method comprises the step of reshaping longitudinal ends of a hollow cylindrical braid material into a dimensionally stable plate-like form.

These simple solutions provide that each of the conductive segments of the network that are connected by the conductive connection assembly according to the invention can move with the carbon fibre-reinforced material of the body and in particular relative to the other conductive elements of the fuselage and more particular to other conductor segments. This relative movement is rendered possible by the braid material, which is inherently flexible/pliable.

The kit according to the invention provides that each of the conductor segments can be electrically conductively connected to one of the other conductive elements of the body independent of the alignment of the conductor segment and the respective conductive element to each other. Depending on the alignment, a conductive connection assembly with a proper arrangement of its longitudinal ends to each other can simply be chosen from the kit when assembling the network. There is no need to bring the conductive interconnection element in the correct form, e.g. by bending.

The solutions according to the invention can be combined as desired and further improved by the further following embodiments that are advantageous on their own, in each case.

According to a first possible embodiment, the longitudinal ends can be consolidated to have the rigid, i.e. dimensionally stable, form by pressing. For instance, a certain predetermined length of each of the longitudinal ends can be inserted into a bushing or cartouche, which is consequently pressed into the plate-like shape. If the connection between the bushing and the braid material is, however, not sufficiently stable, the bushing may be lost. Furthermore, bushings increase the amount of components and complexity of the conductive connection assembly. Hence, it is preferred that the consolidation of the longitudinal ends is done by welding, in particular by ultra-sonic welding.

The conductive interconnection element can be formed with the consolidated longitudinal ends, between which the conductive section is arranged. The consolidation of the braid material results in a higher stiffness of the conductive interconnection element in the consolidated areas compared to non-consolidated areas. Furthermore, if the conductive interconnection element is made of separate parts, i.e. of wires or metal films, these separate parts can be affixed to each other due to the consolidation, thereby avoiding disintegration of the conductive interconnection element. The longitudinal ends may e.g. be consolidated by a cover, which is pressed or glued onto the longitudinal ends. In order to avoid adding the cover, the longitudinal ends can be consolidated by welding, in particular by ultrasonic, pressure or HF pressure welding. Consolidation by welding reduces the weight as the additional cover is not necessary and improves conductivity, as contact resistance between the conductive interconnection element and the cover is avoided.

Compared to other conductive materials, e.g. to copper, aluminium has a higher conductance per kilogram. This material property of aluminium allows for a conductive connection assembly that is lightweight compared to other conductive connection assemblies with different conductive interconnection element materials. Thus, at least the braid material may comprise or even consist of aluminium or aluminium alloy.

The longitudinal ends may be formed with a patterned surface structure, e.g. with grooves or other desired structures, which may extend perpendicular or in other desired directions to a longitudinal direction of the conductive interconnection element, the longitudinal direction extending between the longitudinal ends. The surface structure of the longitudinal ends may in particular be adapted for establishing a form or force fit to other components of the conductive interconnection element.

In order to avoid that the form of the conductive interconnection element has to be changed when assembling the network, the longitudinal ends can be pre-positioned in different positions relative to each other. For instance, the longitudinal ends can be pre-positioned in parallel or at an angular distance to each other. One of the longitudinal ends can be angled with respect to the other longitudinal end around the longitudinal direction or around a width direction of the conductive interconnection element, the width direction extending perpendicular to the longitudinal direction. In order to preposition the longitudinal ends, one of the ends of the conductive interconnection element can be consolidated or pressed at a different angle with respect to the other end.

The braid can initially be a flattened tubular form of interwoven wires. Thus, in this initial state, both longitudinal ends extend parallel to one plane. At least one of the two longitudinal ends may be consolidated in this form. The other one of two longitudinal ends of the connection assembly can be consolidated in its initial or another flattened form, the other flattened form comprising the angular distance to the initial state of the other longitudinal end. Bringing the other one of two longitudinal ends into the other flattened form can occur in a transition. This transition may involve reshaping the flattened to a tubular form and then pressing it into the other flattened form with a different angular configuration with respect to the one longitudinal end of the given length. It is particularly advantageous if the desired angular distance between the longitudinal ends is selected before reshaping the ends. Thereby, mechanical stress, e.g. caused by plastically deforming, e.g. by twisting the braid material, is avoided.

The conductive interconnection element may readily be connected to one of the conductor segments, for instance by a screw or rivet connection. As aluminium forms an oxide layer when exposed to air, the electrical resistance of the oxide layer limits the conductivity of the conductive interconnection element when simply screwing or riveting it directly to the conductor segment. In order to avoid the additional resistance of the oxide layer, the conductive interconnection element may be welded directly to the conductor segment.

In order to improve the manageability and to increase the flexibility of the conductive connection assembly, the conductive connection assembly may comprise at least one lug or adapter element for interconnecting the conductive interconnection element and a conductive segment of the network. The lug is preferably affixed to one of the longitudinal ends by a weld connection. When connecting the lug and the longitudinal end by welding, the oxide layer is destroyed and a low resistance connection is formed. Arc or gas-shielded welding is, however, problematic when welding aluminium. In order to create a weld connection which fulfils high quality standards and e.g. the safety requirements of aircraft design, the weld connection between the conductive interconnection element and the lug may be formed by friction stir welding.

For improving ease of assembly, the lug can be formed with an affixing end or section for being affixed to the longitudinal end. The affixing end section is preferably formed with an affixing opening for at least sectionwise receiving one of the longitudinal ends. Hence, the longitudinal end can be pre-mounted in the affixing opening and can be held in the affixing opening by a form or force fit, possibly improved by the patterned structure of the longitudinal end. For further improving the connection between the conductive interconnection element and the lug, the affixing end may be pressed onto the longitudinal end.

A lug that is essentially formed of aluminium further improves the total weight of the conductive connection assembly. A connection formed by friction stir welding between such a lug and the conductive interconnection element still provides for a high quality weld connection.

The lug can be formed with a mounting end or section that is adapted for being mounted to a conductive element of the body and in particular to a conductor segment of the network. The mounting end section can be adapted to be mounted by welding. Alternatively, if the appropriate surface preparation procedures are followed prior to fixing or if the resistance limitations of the aluminium oxide layer are unproblematic, the mounting end can be adapted to be mounted by a repeatedly detachable connection, e.g. a screw or rivet connection. The mounting may subsequently require to be environmentally sealed by means of an appropriate varnish layer. The mounting and affixing sections can be opposite ends of the lugs.

The conductive connection assembly may furthermore comprise an interconnection lug for interconnecting the lugs or adapter elements and a conductive element, e.g. a conductor segment. The interconnection lug further improves mounting flexibility of the conductive connection assembly. For instance, the conductive interconnection element can be equipped with two lugs or adapter elements, of which one is affixed to a conductive element of the body before mounting the conductive element, e.g. before bonding the conductive segment to the carbon fibre-reinforced material. The interconnection lug can likewise be affixed to another conductive element before mounting it. After affixing the conductive elements in or on the body, a second lug or adapter element, which is affixed to the conductive interconnection element opposite to the other already affixed lug, can simply be mounted to the interconnection lug by a form or force fit, e.g. by a screw or rivet connection.

In particular, in an aircraft but also with other vehicles or objects with the fibre-reinforced body, harsh environmental conditions can exist during operation. Hence, in order to avoid corrosion, the conductive connection assembly may comprise a sealing material, which at least covers the conductive interconnection element. The sealing material may for instance be a heat shrink tube, which may be placed around the conductive interconnection element after affixing the lugs. A shrink tube, however, does not form a moisture-tight seal. Thus, according to an advantageous embodiment, the sealing material is a liquid, which is applied by spraying, painting or immersion at least to the conductive interconnection element and preferably also to the affixing end of the lug.

In order to improve electrical insulation, the conductive connection assembly may comprise an insulation material that completely covers the conductive interconnection element.

Furthermore, the insulation material may also cover at least one lug at its affixing end at least sectionwise.

The insulation material may be applied in a liquid form, e.g. by spraying, painting or immersion. A particularly easy way for applying the insulation material is using a heat shrink tube, into which the conductive interconnection element can at least sectionwise be introduced.

In order to improve the connection between the heat shrink tube and the conductive interconnection element, the sealing material can be a sealing adhesive which is arranged inside the insulation material and in particular between the insulation material and the conductive interconnection element, affixing the insulation material to the conductive interconnection element by bonding.

The conductive connection assembly can comprise at least one conductor segment of the network, the conductor segment being connected to the conductive interconnection element in an electrically conductive manner. Preferably, the conductor segment is affixed to the mounting end of the lug, in particular by a friction stir welding connection.

Furthermore, for protecting items or occupants inside the body from harm due to the electric discharges, the conductor segments of the electrical structural network may be connected to other conductive elements of the body to form a Faraday cage.

The kit according to the invention may be a kit for an aircraft. It can comprise at least two conductive interconnection elements, more than one lug, at least one interconnection lug, insulation material, sealing material and/or at least one conductive element of the body as separate, unconnected or at least partly preassembled components. In particular, the kit may comprise at least one conductor segment of the electrical structural network or of the body, the at least one conductor segment and at least one of the conductive connection assemblies being adapted to be electrically conductively affixed to each other.

Furthermore, the invention relates to an aircraft comprising a carbon fibre-reinforced fuselage with an electrical structural network comprising conductor segments. According to the invention, the object is achieved for the aircraft mentioned above in that at least one of the conductor segments of the network is connected to another conductive element of the fuselage by a conductive connection assembly according to the invention.

An aircraft with a fuselage or another object with a body comprising carbon fibre-reinforced material and the electrical structural network with the conductive connection assembly according to the invention provides that at least some of the conductor segments of the network can move with the carbon fibre-reinforced material and relative to other conductive elements, e.g. to other conductor segments. Thus, mechanical stress to the bonding or another inflexible connection between the conductor segments and the carbon fibre-reinforced material is avoided, thereby extending the durability and lifespan of the bonding connection.

BRIEF DESCRIPTION OF THE DRAWINGS

The invention will be described hereinafter in greater detail and in an exemplary manner using advantageous embodiments and with reference to the drawings. The described embodiments are only possible configurations in which, however, the individual features as described above can be provided independently of one another or can be omitted in the drawings.

DETAILED DESCRIPTION OF THE DRAWINGS

First, a conductive interconnection element 1 of a conductive connection assembly will be described with reference to FIG. 1. The interconnection element 1 is formed with a conductive section 2 which extends between longitudinal ends 3, 4 in a longitudinal direction L of the interconnection element 1. The conductive section 2 may comprise a conductive braid material B of aluminium. In particular, the conductive interconnection element 1 can consist of the conductive aluminium braid material B. The braid material B is preferably made of woven aluminium wires or thin aluminium sheets, which provide that the conductive interconnection element 1 is flexible/pliable and can thus easily be deformed at least in the area of its conductive section 2.

The longitudinal ends 3, 4 are preferably consolidated, rendering the conductive interconnection element 1 in the area of the longitudinal ends 3, 4 rigid. For instance, the braid material B may be consolidated by welding the single woven wires or metal sheets to each other.

Figure 1:
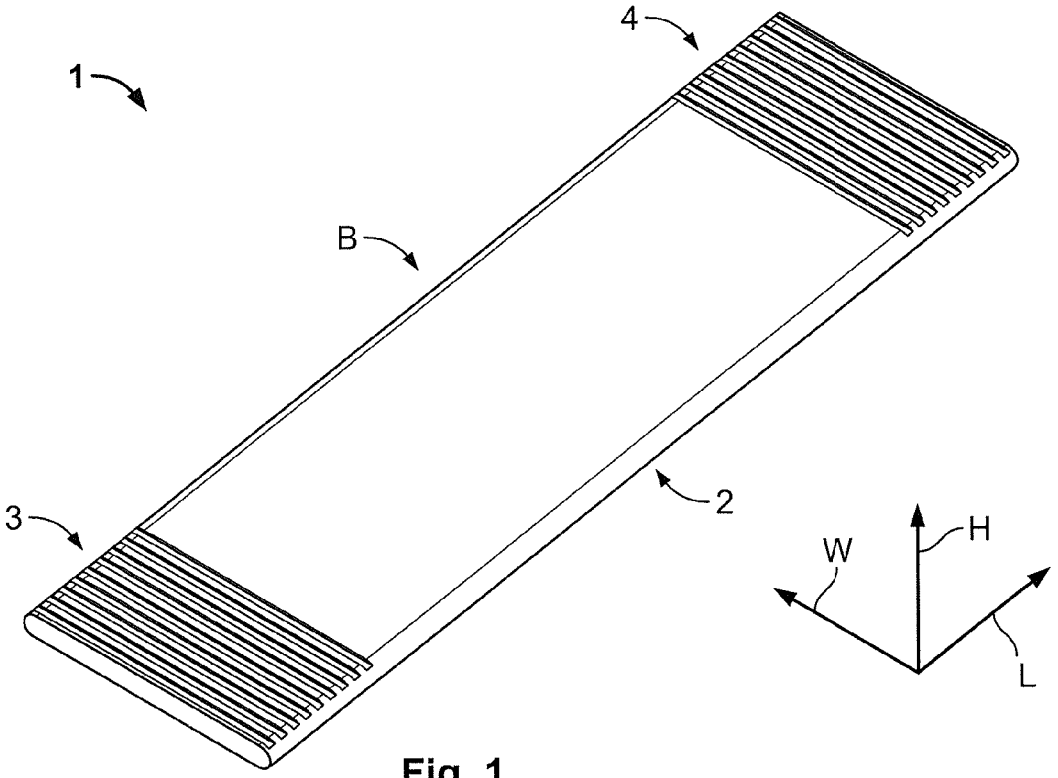
FIGS. 1 and 2 are schematic perspective views of exemplary embodiments of conductive interconnection elements of a conductive connection assembly according to the invention.

In the embodiment of FIG. 1, the conductive interconnection element 1 is arranged in a plane parallel to the longitudinal direction L and a width direction W of the conductive interconnection element 1, the width direction W extending perpendicular to the longitudinal direction L. Hence, the longitudinal ends 3, 4 are arranged parallel to the plane and in particular parallel to each other. As shown in FIG. 1, the longitudinal ends 3, 4 may even be aligned to each other. Alternatively, the longitudinal ends 3, 4 may be offset in parallel with respect to each other in a height direction H, the height direction H standing transversely on the plane defined by the longitudinal direction L and the width direction W. Thus, the longitudinal ends 3, 4 are according to the exemplary embodiment of FIG. 1 prepositioned parallel to each other.

Figure 2:
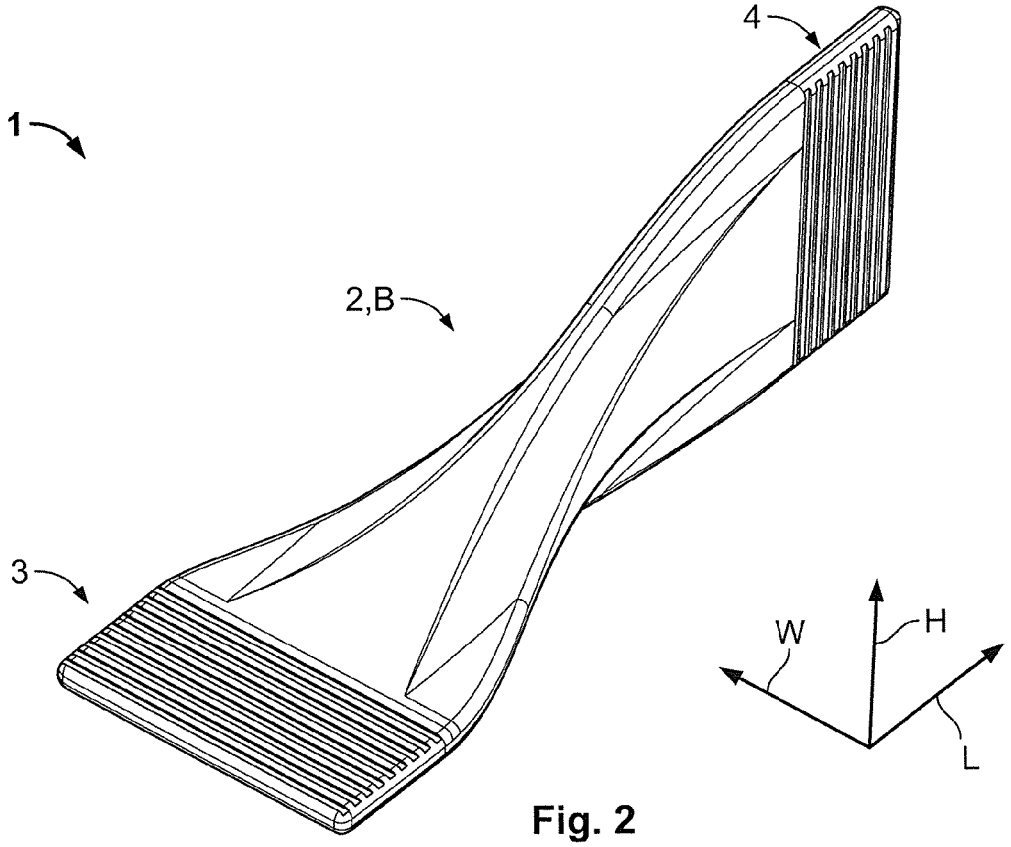

FIG. 2 shows a second exemplary embodiment of the conductive interconnection element 1. Same reference signs are used for elements which correspond in function and/or structure to the elements of the exemplary embodiment of FIG. 1. For the sake of brevity, only differences from the exemplary embodiment of FIG. 1 will be looked at.

According to the embodiment of FIG. 2, the braid material B of one of the longitudinal ends 3, 4 may be consolidated at an angle to the other one of the longitudinal ends 3, 4 so that the longitudinal ends 3, 4 are arranged at an angular distance to each other (in this view 90°).

For instance, the longitudinal end 4 can have an angular position of 90° with respect to the longitudinal end 3, the angle being measured around the longitudinal direction L. The size of the angle around the longitudinal direction L may be different as desired. In the exemplary embodiment of FIG. 2, however, the angle is 90°, such that the longitudinal end 3 is arranged in parallel to the longitudinal direction L and the width direction W and the other longitudinal end 4 extends parallel to the longitudinal direction L and the height direction H. The size of the angle can differ from 90° as desired and can for instance be 15°, 30°, 45°, 60° or 75°.

The braid material B is in an initial state favourably made of a flattened tubular form of interwoven wires. The longitudinal ends 3, 4 may both be consolidated in this initial state. One of the longitudinal ends 3, 4 of a given length can, however, be brought into another flattened form by a transition before consolidating it. For instance, it can be reshaped from the flattened to a tubular form and then pressed into a different angular plate-like configuration with respect to the other of the longitudinal ends 3, 4 of the given length.

The longitudinal ends 3, 4 may also be arranged at an angle to each other around the width direction W. If this angle is 90°, then the longitudinal end 3 is arranged in parallel to the longitudinal direction L and the width direction W and the other longitudinal end 4 is arranged in parallel to the width direction W and the height direction H. The size of the angle around the width direction W can differ from 90° as desired and can e.g. be 15°, 30°, 45°, 60° or 75°.

The conductive interconnection element 1 may be formed in order to preposition the longitudinal ends 3, 4 with respect to each other, without compromising the flexibility of the conductive section 2. The angular position between the longitudinal ends 3, 4 may for instance be determined by the way the wires are braided or the thin metal sheets are preformed or interconnected.

Figure 3:
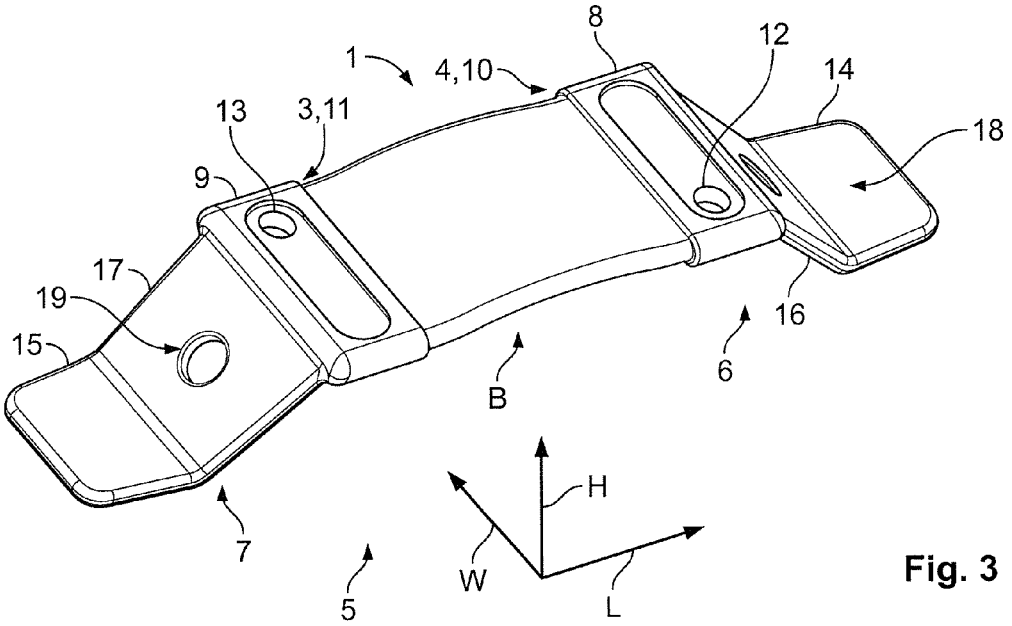
FIG. 3 is a schematic perspective view of a first exemplary embodiment of the conductive connection assembly.

FIG. 3 shows a first exemplary embodiment of a conductive connection assembly 5 with the conductive interconnection element 1 of the exemplary embodiment of FIG. 1. Same reference signs are used for elements which correspond in function and/or structure to the elements of the exemplary embodiment of FIG. 1. For the sake of brevity, only the differences from the exemplary embodiment of FIG. 1 will be looked at.

The conductive connection assembly 5 may comprise at least one and in particular two lugs 6, 7, which are mechanically affixable or already affixed to the longitudinal ends 3, 4 of the interconnection element 1 in an electrically conductive manner. Each of the lugs 6, 7 is preferably shaped with an affixing end or section 8, 9, each of the affixing ends 8, 9 being adapted to be affixed to one of the longitudinal ends 3, 4.

In the embodiment of FIG. 3, the affixing ends 8, 9 are formed with affixing openings 10, 11, which open essentially in or against the longitudinal direction L. Hence, the longitudinal ends 3, 4 may be inserted into the affixing openings 10, 11 parallel to the longitudinal direction L. In the affixing openings 10, 11, the longitudinal ends 3, 4 may be held by a form or force fit.

When assembling the conductive connection assembly 5, it is particularly advantageous, if the longitudinal ends 3, 4 are clamped in the affixing openings 10, 11 by a force fit. Therefore, the longitudinal ends 3, 4 are preferably inserted into the affixing ends 8, 9 via the affixing openings 10, 11. Afterwards, the affixing ends 8, 9 can be compressed in order to affix the longitudinal ends 3, 4 by clamping. The force fit may be enhanced by a patterned surface structure of the longitudinal ends 3, 4 created by press welding. For instance, grooves separated by bars extending in the width direction W may be formed in the surface of the longitudinal ends 3, 4. The consolidation pattern can be different as desired and can e.g. be formed by using appropriate pressing dies.

In FIG. 3, the longitudinal ends 3, 4, however, are not held by a form or force fit but are connected to the respective lug 6, 7 by a material fit. The material fit is preferably a weld connection and in particular a friction stir weld connection. A friction stir weld connection can be visually distinguishable from other welding connections due to an imprint 12, 13 of a tip of a friction stir weld tool or by other known macro- or micro-structural features. Friction stir welding is particularly advantageous, if the conductive interconnection element 1 and/or the lugs 6, 7 are essentially made of aluminium or other hard to weld electrically conductive materials.

Opposite of the affixing ends 8, 9, the lugs 6, 7 may each comprise a mounting end 14, 15 for electrically conductively connecting the respective lug 6, 7 to a conductive element of the body or to a conductive segment of the network. Each of the mounting ends 14, 15 may extend away from the affixing end 8, 9 of the respective lug 6, 7. The mounting end 14, 15 may be offset in parallel to the affixing end 8, 9 of the same lug 6,7 in the height direction H. Alternatively, the mounting end 14, 15 may be tilted with respect to the affixing end 8, 9.

Each of the lugs 6, 7 may be provided with a middle section 16, 17, which interconnects the affixing end 8, 9 and the mounting end 14, 15 of the respective lug 6, 7. The middle section 16, 17 can be formed with a mounting hole 18, 19 that completely extends through the middle section 16, 17 in particular perpendicular to the middle section 16, 17. The mounting holes 18, 19 reduce the weight of the lugs 6, 7. Furthermore, due to the mounting holes 18, 19, the connection assembly 5 can be used more flexibly, as conductive elements of the network can be attached to one of the lugs 6, 7 by a repeatedly detachably connection, e.g. by a screw or rivet connection.

Furthermore, the holes 18, 19 allow for the conductive connection assembly 5 to be repaired in the event of braid damage. The damaged braid can be cut away above the holes 18, 19 and a new bolt or screw on version of the conductive connection assembly 5 can be bolted or screwed to the original lug or adapter element 6, 7. The term above means between the hole 18, 19 and the respective affixing end 8, 9

Figure 4:
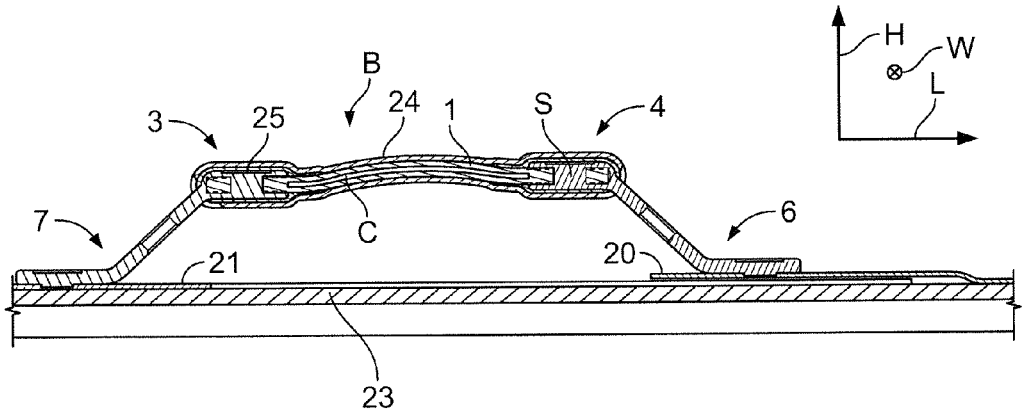
FIG. 4 shows the conductive connection assembly of the embodiment of FIG. 3 in a cross-sectional side view.

FIG. 4 shows the exemplary embodiment of FIG. 3 in a cross-sectional view, the cross-sectional plane extending through the mounting holes 18, 19 parallel to the longitudinal direction L and the height direction H. The lugs 6, 7 are shown affixed to conductive elements 20, 21 of an electrical structural network for a body 23. Each of the conductive elements 20, 21 may be a conductor segment. Hence, the lugs 6, 7 and the interconnection element 1 interconnect the conductive elements 20, 21 electrically conductively. Each of the conductive elements 20, 21 may be part of the conductive connection assembly 5. At least one of the conductive elements 20, 21 may be affixed to one of the lugs 6, 7 before the conductive element 20, 21 is mounted to the body 23, e.g. to the aircraft fuselage, the car body, the hull, the superstructure, the body of the device or the building. In the embodiment shown in FIG. 4, the conductive elements 20, 21 are already mounted to a carbon fibre-reinforced polymer part of the body 23 by bonding, e.g. via an adhesive agent.

As can be easily seen in this side view along the width direction W, the interconnection element 1 slightly curves away from the body 23. Hence, if the conductive elements 20, 21 move with respect to each other and in particular towards or away from each other, this movement is not hindered by the conductive interconnection element 1.

The conductive connection assembly 5 may furthermore comprise an insulation material 24, electrically insulating the interconnection element 1 and possibly at least parts of the affixing ends 8, 9 from the environment. The insulation material 24 can for instance be a heat shrink tube that extends from affixing end 8 over the interconnection element 1 to the affixing end 9.

Alternatively or additionally, the conductive connection assembly 5 may be provided with a sealing material 25 that sealingly encloses at least the interconnection element 1 and possibly also at least parts of the affixing ends 8, 9. The sealing material 25 can seal the interconnection element 1 against moisture. In a particular advantageous embodiment, the sealing material 25 is a sealing adhesive, which affixes the insulation material 24 to the interconnection element 1 and possibly also to the affixing ends 8, 9.

A friction stir weld connection between the longitudinal end 4 and the affixing end 8 is designated by the letter S.

The braid B can be shaped from a flattened tubular form of interwoven wires. Hence, in such an embodiment, a cavity C between the flattened form is inherent in its construction.

Figure 5:
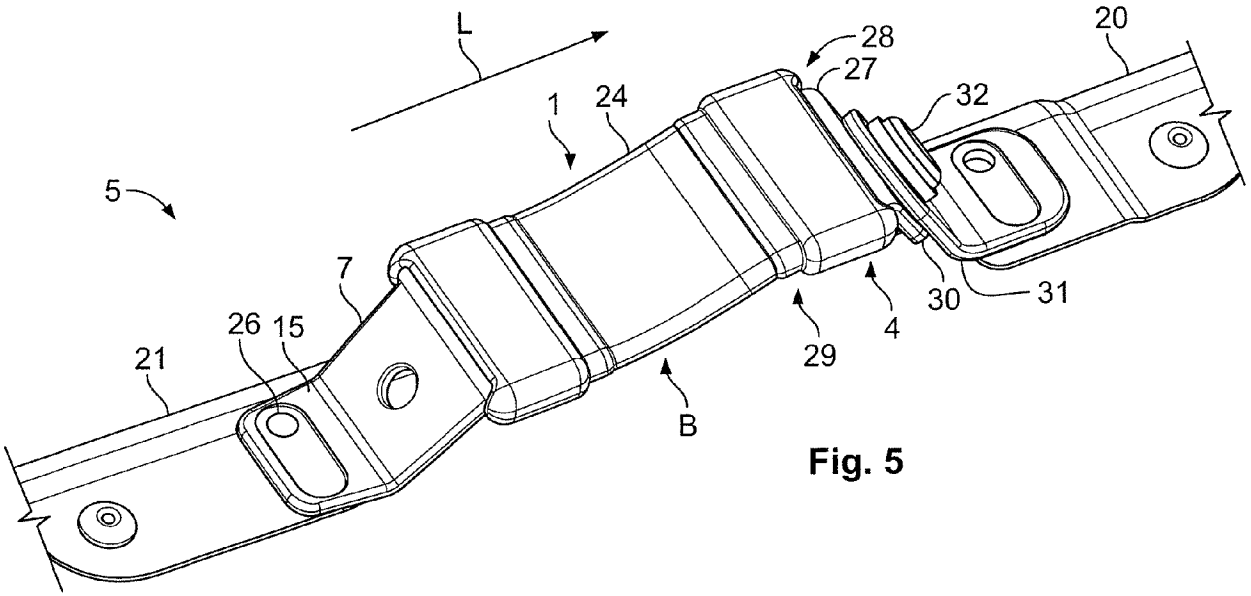
FIG. 5 is a schematic perspective view of a second exemplary embodiment of the conductive connection assembly.

FIG. 5 shows another embodiment of the conductive connection assembly 5 with a conductive interconnection element 1 according to the exemplary embodiment of FIG. 1. Same reference signs are used for elements which correspond in function and/or structure to the elements of the exemplary embodiment of FIG. 1, 3 or 4. For the sake of brevity, only the differences from the exemplary embodiments of FIGS. 1, 3 and 4 will be looked at.

FIG. 5 shows the conductive connection assembly 5 with the conductive interconnection element 1 of FIG. 1 and with lug or adapter element 7 of FIGS. 3 and 4. The mounting end 15 of lug 7 may be affixed to the conductive element 21 by friction stir welding, which can be e.g. recognized by an imprint 26 in the weld connection between the mounting end 15 and the conductive element 21. The longitudinal end 4 of the interconnection element 1, which is opposite of the lug 7, may as shown in FIG. 5 be electrically conductively affixed to an adapter lug 27. The adapter lug 27 may be provided with an affixing end or section 28 similar to the affixing end 8 of the lug 6 or the adapter element. The affixing end 28 can thus be formed with an affixing opening 29, which opens against the longitudinal direction L. The affixing opening 29 is in FIG. 5 covered by the insulation material 24 and is therefore not visible. The affixing opening 29 may be similar to affixing opening 10 of the lug 6 and can be adapted to clampingly receive longitudinal end 4 of the conductive interconnection element 1. Two of the adapter lugs 27 can be affixed to the longitudinal ends 2, 4 of the braid material B. Such a repair arrangement can be used for replacing a damaged braid.

A mounting end or section 30 is directly connected to the affixing end 28 and may extend in parallel to the longitudinal direction L. In the alternative, the mounting section 30 may be tilted with respect to the affixing end 28 and to the longitudinal direction L. Therefore, lug 27 may be designated as an adapter angle. The adapter angle can be made of aluminium, too.

Furthermore, FIG. 5 shows the conductive connection assembly 5 with an interconnection lug 31, which is shown affixed to the conductive element 20. Again, the interconnection lug 31 may be made of aluminium and can be connected to the conductive element 20 by a friction stir weld. Initially, the interconnection lug 31 may have had the same form as lug 6, 7. However, when replacing a damaged braid material B, lug 6,7 may be cut above the hole 18, 19, thereby creating the interconnection lug 31.

In order to be able to easily affix the adapter lug 27 to the interconnection lug 31, the adapter lug 27 and the interconnection lug 31 can be adapted to be connected by a form or force fit, in particular by a repeatedly detachably connection and more particular by a screw or rivet connection. In the embodiment of FIG. 5, the adapter lug 27 and the interconnection lug 31 are interconnected by a screw 32.

Figure 6:
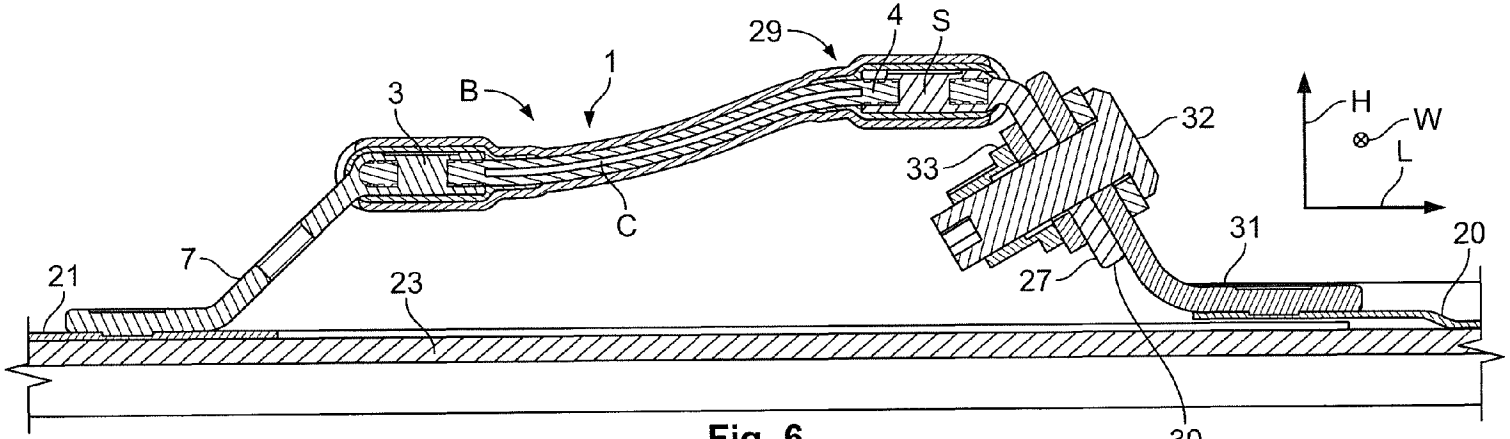
FIG. 6 shows the conductive connection assembly of the embodiment of FIG. 5 in a cross-sectional side view.

FIG. 6 shows the exemplary embodiment of FIG. 5 in a cross-sectional view, a cross-sectional plane extending parallel to the longitudinal direction L and the height direction H.

In the side view of FIG. 6, the affixing opening 29 of adapter lug 27 is visible. Longitudinal end 4 extends into the affixing opening 29 and is affixed thereto by friction stir weld S.

Adapter lug 27 and interconnection lug 31 may both essentially be shaped as angle brackets or angled adapter elements which, when affixed to each other, e.g. by a screw 32, follow the stepped form lug 6, 7. As can be seen in FIG. 6, neither the lug 27 nor the interconnection lug 31 need to comprise a thread for screw 32, as screw 32 can use a screw nut 33 as a counter bearing for clamping the mounting end 30 to the interconnection lug 31.

In order to enable the conductive elements 20, 21 to move with respect to each other together with the carbon fibre-reinforced material of the body 23, the conductive interconnection element 1 is shown slightly bent to a S-form, wherein its longitudinal ends 3, 4 essentially extend in parallel to the longitudinal direction L and longitudinal end 4 is arranged behind longitudinal end 3 in the height direction H.

Figure 7:
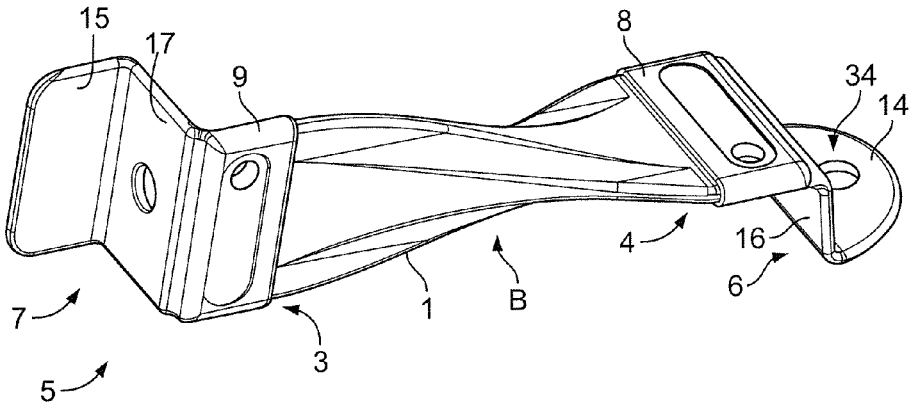
FIG. 7 is a schematic perspective view of a third exemplary embodiment of the conductive connection assembly.

FIG. 7 shows another embodiment of the conductive connection assembly 5, which is equipped with a conductive interconnection element 1 according to the exemplary embodiment illustrated in FIG. 2.

The longitudinal ends 3, 4 of the interconnection element 1 are affixed to the affixing ends 8, 9 of the lugs 6, 7. Each of the lugs 6, 7 of the embodiment of FIG. 8 can be formed with an affixing end 8, 9, a mounting end 14, 15 and a middle section 16, 17 therebetween. In the embodiments of FIGS. 3 to 6, the affixing end 8, 9 and the mounting end 14, 15 of one of the lugs 6, 7 are arranged at a distance from each other along the longitudinal direction L, such that angles between the middle section 16, 17 and the affixing end 8, 9 or the mounting end 14, 15 are obtuse angles. Furthermore, the angles formed by adapter lug 27 and interconnection lug 31 are also shown obtuse, such that a connecting section of the interconnection lug 31 is arranged at a distance to the affixing end 28 of lug 27 in the longitudinal direction L. The lugs 6, 7, 27, 31 may, however, have a different shape and can for instance have essentially right angles between the middle sections 16, 17 and the corresponding affixing end 8, 9 or mounting end 14, 15.

According to the embodiment of FIG. 7, lug 7 is provided with a mounting end 15 that is adapted for being welded to the conductive element 21. Lug 6 is formed with a mounting end 14, that is adapted to be connected to the conductive element 20 by a form or force fit or by a repeatedly detachable connection, e.g. by a screw or rivet connection. Therefore, the mounting end 14 is provided with a mounting hole 34 for at least sectionwise receiving a screw or a rivet.

Figure 8:
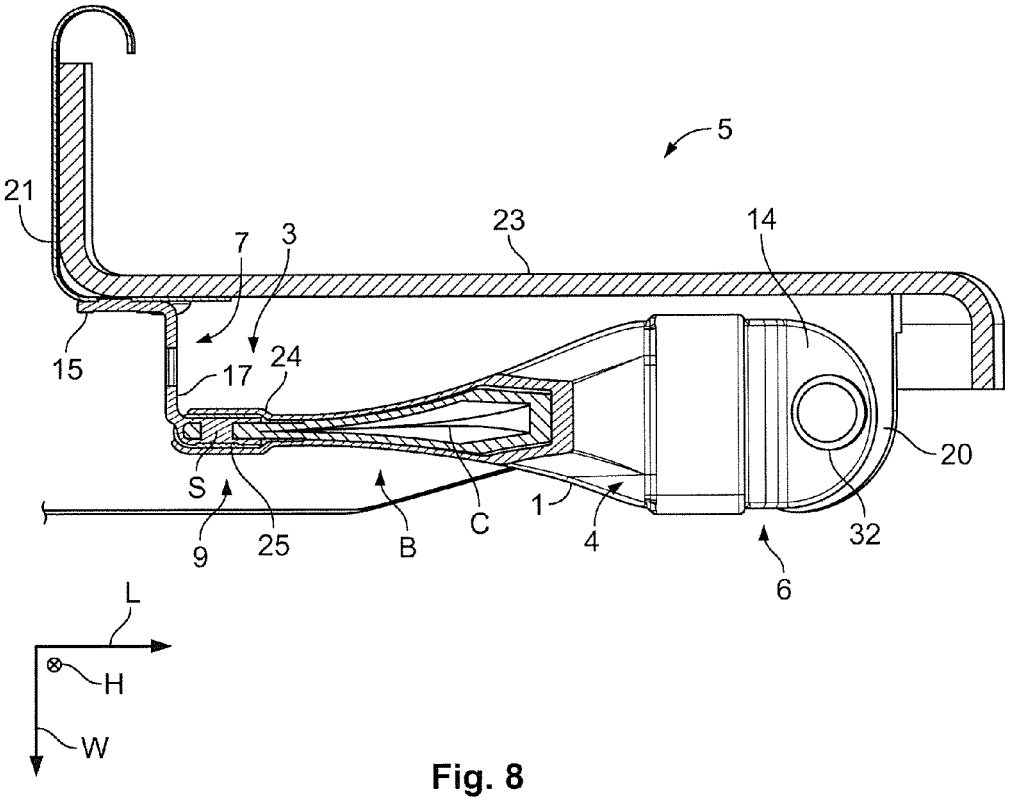
FIG. 8 shows the conductive connection assembly of the embodiment of FIG. 7 in a cross-sectional top view.

FIG. 8 shows the exemplary embodiment of FIG. 7 in a cross-sectional view, the cross-sectional plane extending parallel to the longitudinal direction L and the width direction W and intersecting the conductive connection assembly 5 before the longitudinal end 4 of the conductive interconnection element 1 in the height direction H.

The mounting end 15 of the lug 7 is shown affixed to the conductive element 21, the conductive element 21 essentially extending in the height direction H. The other conductive element 20, however, extends in a plane perpendicular to the conductive element 21, i.e. along the longitudinal direction L and the width direction W. Alternatively, the conductive elements 20, 21 may be arranged at an obtuse angle to each other. Due to the form of the interconnection element 1 with its longitudinal ends 3, 4 arranged at an angle of about 90° to each other, the conductive elements 20, 21 can be interconnected without effort, even with the conductive elements 20, 21 not being arranged in parallel to each other or in a common plane. The angle between the longitudinal ends 3, 4 can be adapted to the position of the conductive elements 20, 21 with respect to each other. Thus, the longitudinal ends 3, 4 and the conductive elements 20, 21 are preferably arranged at similar angles to each other.

Due to the arrangement of the cross-sectional plane, only longitudinal end 3 is shown in a cross-sectional view. Longitudinal end 4 is shown in a plan view.

Again, the conductive interconnection element 1 is preferably affixed to the lug 7 by a weld connection between the longitudinal end 3 and the affixing end 9. The weld connection is shown as a friction stir weld S. The mounting end 15 of the lug 7 is preferably welded to conductive element 21. Conductive element 21 can again be affixed to the carbon fibre-reinforced material of the body 23, e.g. of the aircraft fuselage.

The mounting end 14 of lug 6 is preferably affixed to the conductive element 20 by the screw 32 or by a rivet.

In order to electrically seal the conductive interconnection element 1, the conductive connection assembly 5 may be provided with the insulation material 24 which can be provided by a heat shrink tube which extends from lug 6 to lug 7 and enfolds the conductive interconnection element 1 and at least parts of the affixing ends 8, 9. In order to seal the conductive interconnection element 1 against moisture, sealing material 25 may be provided on the conductive interconnection element 1 and may also coat the affixing ends 8, 9. For affixing the insulation material 24, the sealing material 25 can again be provided as a sealing adhesive.

Figure 9:
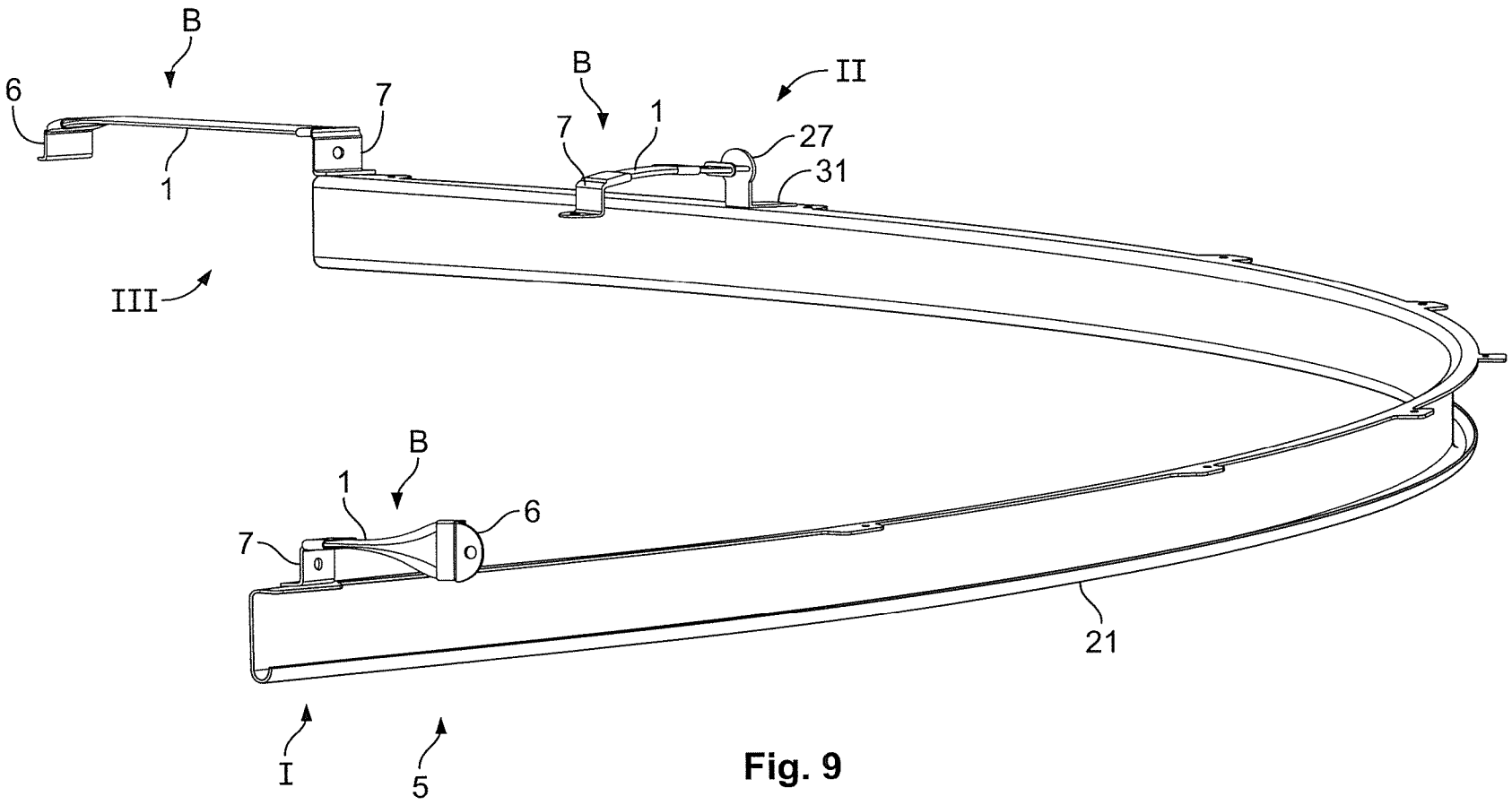
FIG. 9 shows the conductive connection assembly according to a fourth exemplary embodiment of the invention with a conductor segment in a schematic perspective view.

FIG. 9 shows another embodiment of the conductive connection assembly 5 in a schematic perspective view. Same reference signs are used for elements which correspond in function and/or structure to the elements of the exemplary embodiments of FIGS. 1 to 9. For the sake of brevity, only the differences from the exemplary embodiments of FIGS. 1 to 9 will be looked at.

The conductive connection assembly 5 may comprise a conductive element 21 of the body 23 or a conductor segment of the electrical structural network of the body, hence a aircraft fuselage, the car body, the hull, the superstructure, the body of the device or the building. The conductive element 21 may be formed to be affixed to the body by bonding and may be dimensioned to encircle a storage or passenger compartment of the body at least sectionwise.

The conductive connection assembly 5 of FIG. 9 can be connected to other conductive elements of the body via a multitude and e.g. three conductive interconnection elements 1. The number of conductive interconnection elements 1 per conductive connection assembly 5 can be varied as required.

Each of the three conductive interconnection elements 1 is shown arranged in a first, a second or a third connecting area I, II, III. Conductive interconnection element 1 in connecting area I can be formed according to the exemplary embodiment of FIG. 2. The lugs 6, 7 in connecting area I can thus correspond to the lugs 6, 7 of FIGS. 7 and 8.

In connecting areas II and III, the conductive interconnection element 1 is illustrated with a straight shape, as shown in the exemplary embodiment of FIG. 1. In connecting area II, lug 7 may correspond to the lug 6 of FIGS. 7 and 8. The lug 6 of FIG. 9 can, however, be replaced by the lug 27 in combination with the interconnection lug 31. In contrast to the lug 27 and the interconnection lug 31 as shown in FIG. 5, the lug 27 and the interconnection lug 31 of FIG. 9 may both define arbitrary and in particular right angles.

As can be seen in connecting area III, the straight conductive interconnection element 1 can be affixed to two of the lugs 6, 7 of FIG. 8.

Hence, not only the shape and length of the conductive interconnection element 1 can be selected as desired, but also the form and combination of lugs 6, 7, 27 and also the interconnection lug 31 can be used as desired.

The invention claimed is:

1. A conductive connection assembly for connecting conductor segments of an electrical structural network of a body to other conductive elements of the body, the conductive connection assembly being adapted to conduct electric discharges and comprising a conductive interconnection element with a conductive section, wherein the conductive section is formed by a hollow cylindrical braid material with two longitudinal ends, the longitudinal ends being consolidated to have a rigid plate-like form wherein the longitudinal ends are prepositioned at an angle to each other.

2. The conductive connection assembly according to claim 1, wherein the conductive connection assembly comprises at least one lug for interconnecting the conductive interconnection element and a conductor segment of the network, the lug being affixed to one of the longitudinal ends by a weld connection.

3. A conductive connection assembly for connecting conductor segments of an electrical structural network of a body to other conductive elements of the body, the conductive connection assembly being adapted to conduct electric discharges and comprising a conductive interconnection element with a conductive section, wherein the conductive section is formed by a hollow cylindrical braid material with two longitudinal ends, the longitudinal ends being consolidated to have a rigid plate-like form, wherein the conductive connection assembly comprises at least one lug for interconnecting the conductive interconnection element and a conductor segment of the network, the lug being affixed to one of the longitudinal ends by a weld connection, and wherein the lug is formed with an affixing end for being affixed to one of the longitudinal ends, the affixing end being formed with an affixing opening for at least sectionwise receiving one of the longitudinal ends.

4. A conductive connection assembly for connecting conductor segments of an electrical structural network of a body to other conductive elements of the body, the conductive connection assembly being adapted to conduct electric discharges and comprising a conductive interconnection element with a conductive section, wherein the conductive section is formed by a hollow cylindrical braid material with two longitudinal ends, the longitudinal ends being consolidated to have a rigid plate-like form, the conductive connection assembly comprises an insulation material that completely covers the conductive interconnection element, wherein the conductive connection assembly comprises at least one lug for interconnecting the conductive interconnection element and a conductor segment of the network, the lug being affixed to one of the longitudinal ends by a weld connection, and wherein the at least one lug comprises an interconnection lug for interconnecting the conductive interconnection element and a conductor segment of an electrical structural network of body.

5. The conductive connection assembly according to claim 4, wherein the insulation material covers the lug at its affixing end at least sectionwise.

6. A conductive connection assembly for connecting conductor segments of an electrical structural network of a body to other conductive elements of the body, the conductive connection assembly being adapted to conduct electric discharges and comprising a conductive interconnection element with a conductive section, wherein the conductive connection assembly comprises an insulation material, wherein the conductive section is formed by a hollow cylindrical braid material with two longitudinal ends, the longitudinal ends being consolidated to have a rigid plate-like form, wherein at least the conductive interconnection element is covered by a sealing material, and wherein the sealing material is a sealing adhesive, the sealing adhesive being arranged between the insulation material and the conductive interconnection element.

7. The conductive connection assembly according to claim 1, wherein the conductive connection assembly comprises at least one conductor segment for the network, the conductor segment being connected to the conductive interconnection element in an electrically conductive manner.

8. A kit, comprised of at least two conductive connection assemblies, each conductive connection assembly for connecting conductor segments of an electrical structural network of a body to other conductive elements of the body, the conductive connection assemblies being adapted to conduct electric discharges and each comprising a conductive interconnection element with a conductive section, wherein the conductive section is formed by a hollow cylindrical braid material with two longitudinal ends, the longitudinal ends being consolidated to have a rigid plate-like form, wherein the conductive interconnection element of one of the conductive interconnection assemblies is different in length or its longitudinal ends are differently arranged with respect to each other compared to the conductive interconnection element of another one of the conductive interconnection element assemblies.

9. The kit according to claim 8, comprised by at least one conductor segment of an electrical structural network of a body, the at least one conductor segment and at least one of the conductive interconnection element assemblies being adapted to be electrically conductively affixed to each other.

10. A method for manufacturing a conductive connection assembly for connecting conductor segments of an electrical structural network of a body to other conductive elements of the body, the conductive connection assembly being capable of conducting electric discharges, wherein the method comprises the step of reshaping longitudinal ends of a hollow cylindrical braid material into a dimensionally stable plate-like form, wherein the step of reshaping the longitudinal ends is accomplished by a consolidating process.

11. The method of claim 10, further comprised by the step of selecting an angular distance between the reshaped longitudinal ends before reshaping them.

12. The conductive connection assembly according to claim 4, wherein the lug further comprises an adapter lug coupled to the interconnection lug.

* * * * *